United States Patent [19]

Pacheco-Pifano

[11] Patent Number: 4,650,150

[45] Date of Patent: Mar. 17, 1987

[54] MOLD APPARATUS FOR VERTICAL ELEMENTS OF CONCRETE

[75] Inventor: Oscar Pacheco-Pifano, Caracas, Venezuela

[73] Assignee: Opako, S.A., Panama City, Panama

[21] Appl. No.: 769,669

[22] Filed: Aug. 5, 1985

Related U.S. Application Data

[63] Continuation-in-part of Ser. No. 725,307, Apr. 19, 1985, abandoned.

[51] Int. Cl.[4] ..... E04G 11/02

[52] U.S. Cl. ..... 249/19; 249/27; 249/146; 249/152; 249/177; 249/180; 249/184

[58] Field of Search ..... 249/13, 18, 19, 20, 249/22, 27, 146, 152, 162, 175, 177, 178, 180, 249/184, 185, 10, 11

[56] References Cited

U.S. PATENT DOCUMENTS

| | | | |
|---|---|---|---|
| 143,005 | 9/1873 | Gallagher | 249/180 |
| 1,192,493 | 7/1916 | Blomberg | 249/180 |
| 2,458,055 | 1/1949 | Buebke | 249/180 |
| 2,680,276 | 6/1954 | Filangeri | 249/180 |
| 2,799,911 | 7/1957 | Hutchins et al. | 249/152 |
| 3,558,095 | 1/1971 | McNiel | 249/13 |
| 3,811,646 | 5/1974 | Beasley | 249/144 |
| 3,814,374 | 6/1974 | Beemer et al. | 249/179 |
| 3,822,853 | 7/1974 | Shelley | 249/27 |
| 4,029,287 | 6/1977 | Burdett | 249/27 |
| 4,088,296 | 5/1978 | Armas | 249/180 |
| 4,252,291 | 2/1981 | Armas | 249/27 |

FOREIGN PATENT DOCUMENTS

| | | | |
|---|---|---|---|
| 2115986 | 12/1971 | Fed. Rep. of Germany | 249/180 |
| 25795 | 4/1915 | Norway | 249/180 |

*Primary Examiner*—Jay H. Woo
*Assistant Examiner*—James C. Housel
*Attorney, Agent, or Firm*—Cushman, Darby & Cushman

[57] ABSTRACT

A molding apparatus for molding in place walls of a structure on a poured concrete floor or other base is provided with a central support member to which are movably attached four flat wall molds and four corner molds which cooperate with adjacent like apparatus and also with conventional exterior molds in forming a cast structure; the apparatus has actuating members for effecting retraction firstly of the flat wall molds and then of the corner molds toward the central support member upon completion of a casting operation and after hardening of the cast materials; the flat wall and corner molds are connected to the central support member by means of a plurality of lost motion connectors in such a manner that the aforementioned retraction is accomplished, after disengagement of locking devices, first by the flat wall molds and then, after a selected delay, by the corner molds; then, while in this position, the apparatus is removed and transported to another location where it will be set in its place in an expanded position.

19 Claims, 23 Drawing Figures

61
56
63
54
24
52
12
26
66
92
91

MOLD APPARATUS FOR VERTICAL ELEMENTS OF CONCRETE

BACKGROUND AND SUMMARY OF THE INVENTION

This is a continuation-in-part of Ser. No. 725,307, filed Apr. 19, 1985, now abandoned.

Ihe present invention relates to an apparatus for forming walls of a building structure in combination with conventional outer wall forming elements and, in particular, to a wall forming mold apparatus which can be easily set in place relative to other mold members and includes actuating means for retracting the mold members after the concrete has set. The entire apparatus is then removed and transported to another location for another molding operation.

Molding apparatus for forming walls in situ of poured concrete or other cementitious material have long been known. Such devices have been employed to set up a molding pattern where cementitious material is poured between mold elements; the cementitious material is allowed to set and then the mold elements are mechanically retracted and then removed from the formed walls. While a number of such devices are known in the prior art and have been successfully used to form cast structural elements on a base, they have, in general, been cumbersome and expensive to use or have been difficult to rapidly set up, operate and transport.

Representative prior art includes the following U.S. Pat. Nos. 2,799,911; 3,558,095; 3,811,646; 3,822,853; 4,029,287; 4,088,296 and 4,252,291.

The present invention overcomes the disadvantages ofthe prior molding apparatus and, in addition, provides the advantages of lower initial costs, ease of operation as well as increased operating speed wherein the apparatus can be utilized at one location at a site to mold wall elements and then quickly disengaged from the cast structure and moved to an adjacent site for another molding operation. With a set of the apparatus, a builder will be able to use the molding set at a site to construct very rapidly and very inexpensively an entire dwelling having multiple rooms as well as multiple dwellings with either the same or different floorplans.

In summary, the present invention provides a molding apparatus which, in combination with similar devices and with conventional exterior mold elements, serves for pouring vertical elements of concrete. In one embodiment, the present invention includes a central support member which may be of any desired shape when viewed in plan or any desired height. In a preferred embodiment, the central support member is constructed as a framework which may use any suitable building elements such as, for example, steel angles which are assembled as by welding into a suitable framework which will be self-standing on a base such as a floor, which may be cast concrete. Anchoring means are provided to precisely locate the central support member on the floor. For each side and for each corner of the support member there will be provided a mold plate such as steel plate which is mounted on a frame member so as to impart rigidity to the mold plate. The frame members for the mold plates are connected by attachment means of a special design to the facing side and to the corners of the central support member. The attachment means will enable the frame members and associated molding members or plates to be moved towards and away from the central support members.

Actuating means are provided in the form of an upper platform which is movably mounted relative to the upper end of the central support member and connected to the attachment means through several linkage assemblies so that when the upper platform is raised relative to the upper end of the support member, the frame members and mold plates mounted thereon will be moved inwardly and upwardly toward the central support member and away from the cast concrete wall. The entire assembly may then be lifted out of the cast walls such as by a lift crane and transported to some other location for carrying out another molding process. The outer conventional mold members are preferable such as to be easily moved to the next location and, i.e., assembled. With the foregoing arrangement, as described in more detail herein, very rapid and accurate molding of structural elements such as walls can be effected.

The foregoing and other advantages of the present invention will become apparent when consideration is given to the following detailed description taken in conjuntion with the accompanying drawings, in which:

DETAILED DESCRIPTION OF THE INVENTION

Figure 1:
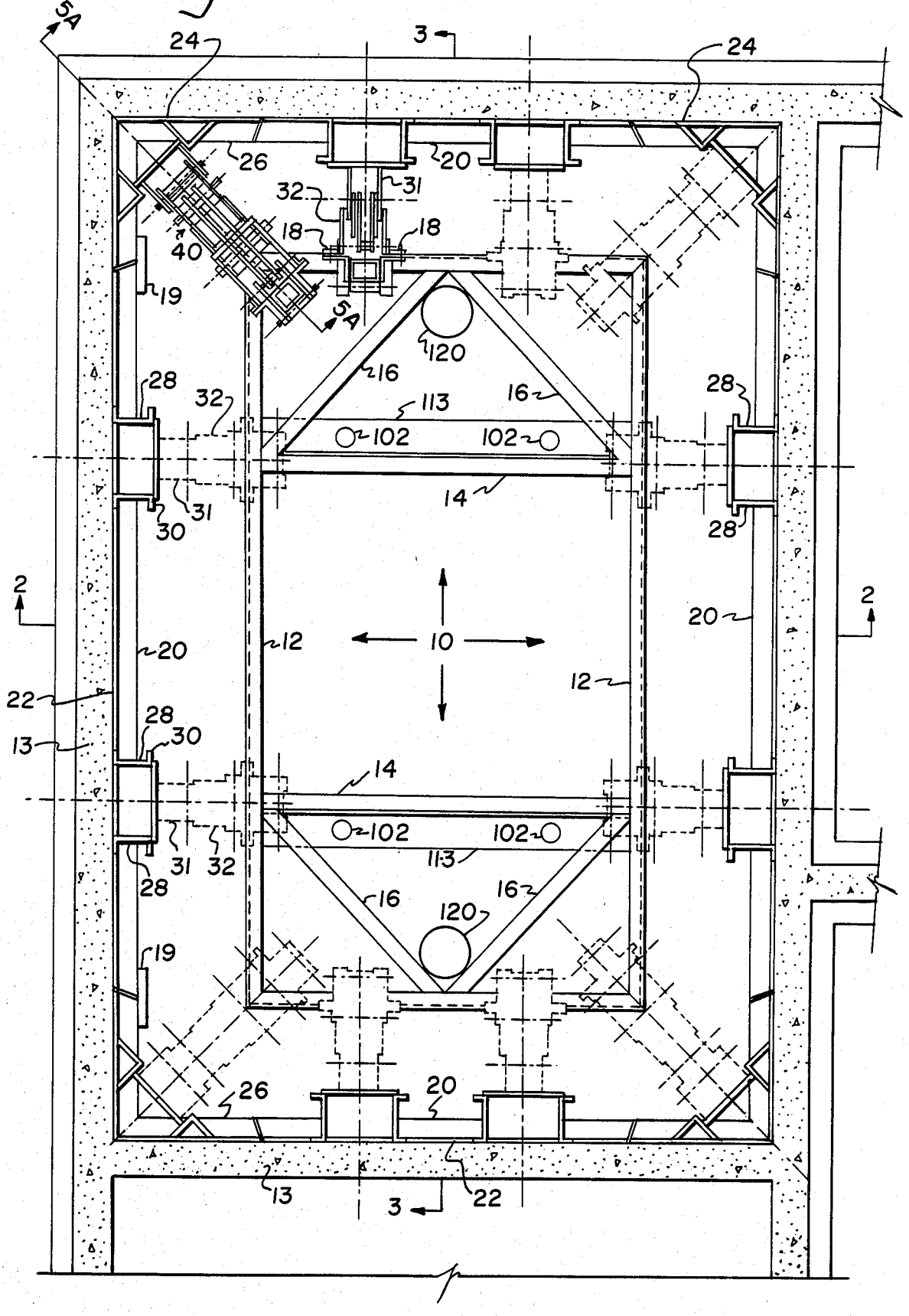
FIG. 1 is a top plan view of one embodiment of the present invention with the lid deleted for clarity.
Figure 2:
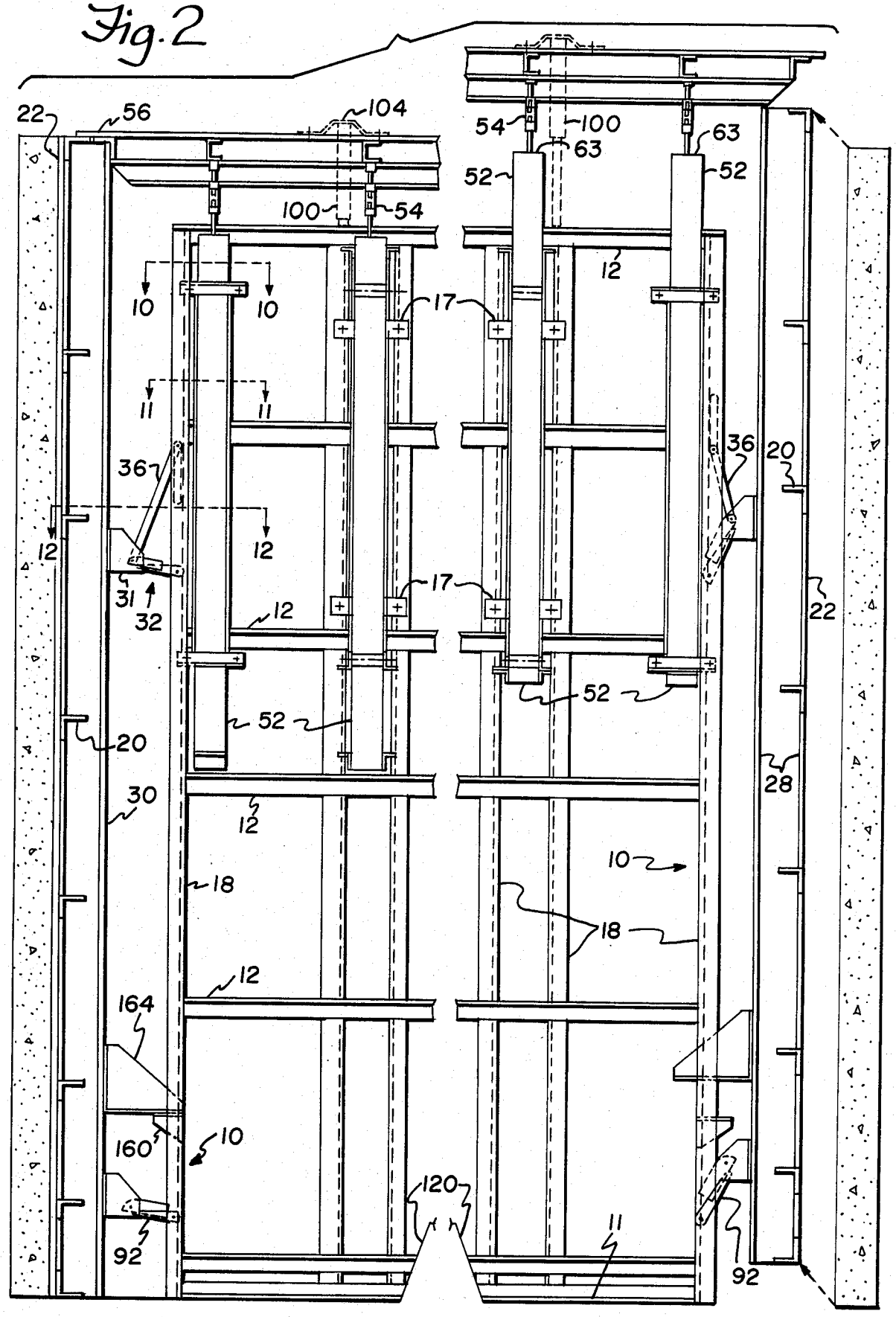
FIG. 2 is a view along lines 2—2 of FIG. 1 with the left side in the expanded position and the right side shown in the contracted position.
Figure 3:
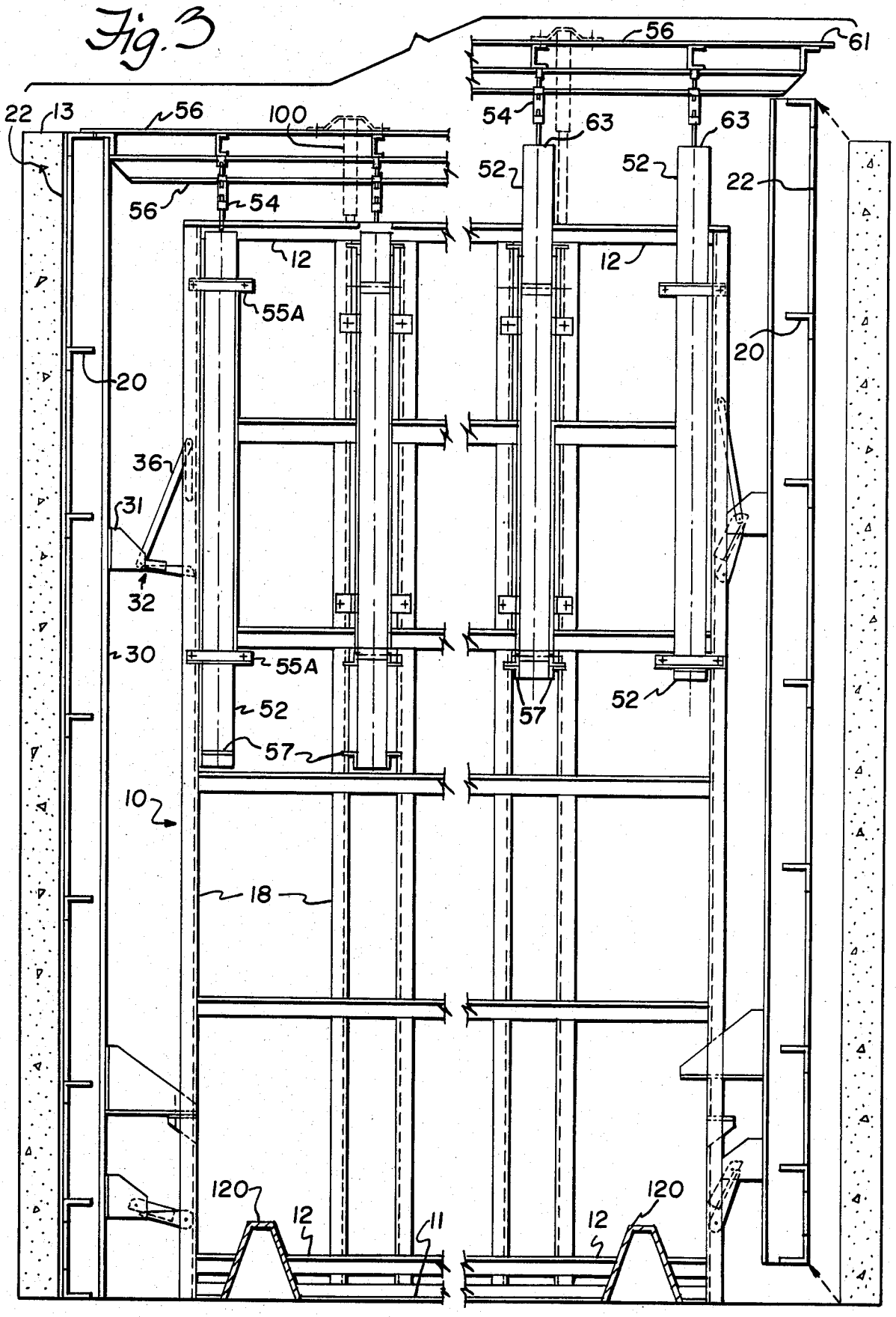
FIG. 3 is a view along lines 3—3 of FIG. 1 with the elements disposed as shown in FIG. 2.

Referring now to the drawings wherein like numerals designate corresponding parts throughout the several views, there are shown in FIGS. 1–3 top, plan and side sectional views in elevation of the apparatus of the present invention. The apparatus includes a central support member or core 10 which may be constructed from a plurality of frame members 12, called angles, in a form to correspond to the enclosure to be cast. In the illustrated embodiment, a conventional rectangle will be formed so that the central support member 10 is rectangular in plan view. The support member may be constructed from angles 12 in a form to correspond to the enclosure to be cast. Interiorly of the angles 12, additional strengthening for the frame may be provided by triangular frame angles 14 and 16, as illustrated. As shown in FIG. 2, a plurality of the angle frameworks may be stacked in spaced relation by welding the peripheries of the angles 12 to vertical angles 18, and which are spaced about the periphery of the resulting framework. With the illustrated arrangement, a rigid yet relatively light support core member is provided whereby the apparatus will be easily transportable.

In the illustrated embodiment, the support member 10 has four sides which are mutually orthogonal and each support the linkage assemblies of the mold apparatus.

The frame members 20 are welded to the mold plate 22 and extend longitudinally as shown in FIGS. 1–3; on the exterior side of the frame members 20, a flat or planar mold member in the form of a steel plate 22 is rigidly secured as by welding where the mold plate 22 contacts the frame members 20.

The horizontal dimension of the mold plate 22 and the corresponding frame member 20 is selected to allow for the location of corner mold members 24 which are reinforced by spaced angles or other suitable structural members 26 as shown in FIG. 1. While, in the illustrated embodiment the corner mold members 24 define an angle of 90 degrees between the two faces thereof, it will be understood that other angular orientations may be employed. As illustrated, it will be appreciated that a face of the mold for the structure to be cast in concrete will comprise one face of one corner mold member 24, a mold plate 22 and the contiguous face 24 of the corner mold member adjacent the other end of plate 22.

Figure 6:
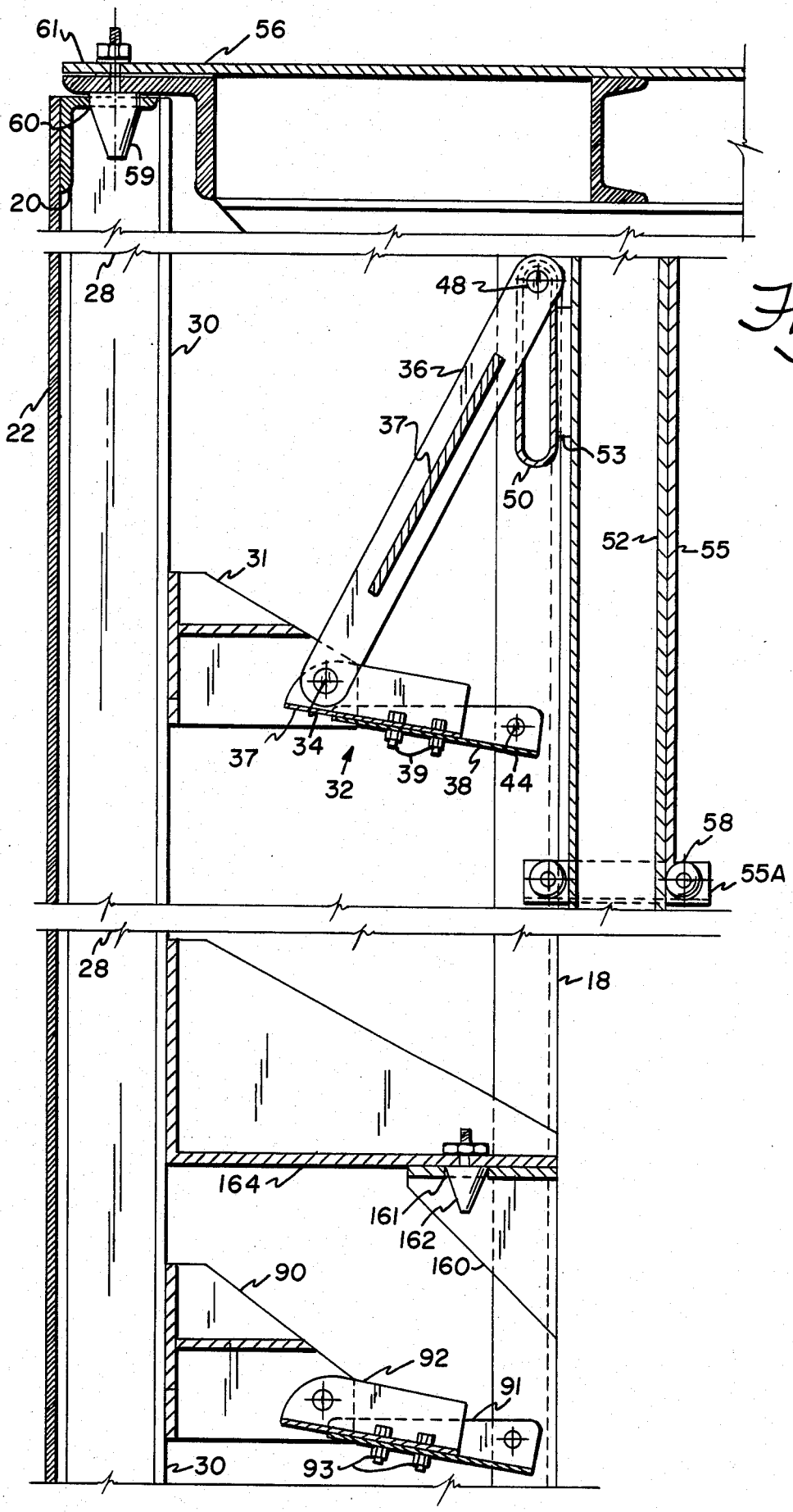
FIG. 6 is an enlarged detail view in side section of attachment elements for a side mold member, with portions deleted for clarity.

Welded to the inner face of each mold plate 22 on the side of the frame members 20 are a plurality of vertically extending U-shaped members 28, with the members 28 facing away from each other as illustrated in FIG. 1. The frame members 20 are welded to the mold plate 22 and extend longitudinally as shown in FIGS. 1–3; the horizontal legs of members 20 are interrupted in their span between the U-shaped members, as shown in FIG. 1. Suitably secured as by welding to the legs 30 of adjacent U-shaped members 28, are a plurality of spaced brackets 31 for the attachment means 32 and 36 of the present invention, as shown in FIG. 2. As illustrated in FIG. 6, each bracket 31 has a pin 34 passing through both of its two flanges; pin 34 receives attachment means 32 formed by parts 37 and 38 and also receives linkage arm 36. The other end of arm 36 is connected to the actuating means through a lost motion connector as explained below, while the other end of the arm 32 is pivotally connected as described below to member 10.

Figure 13:
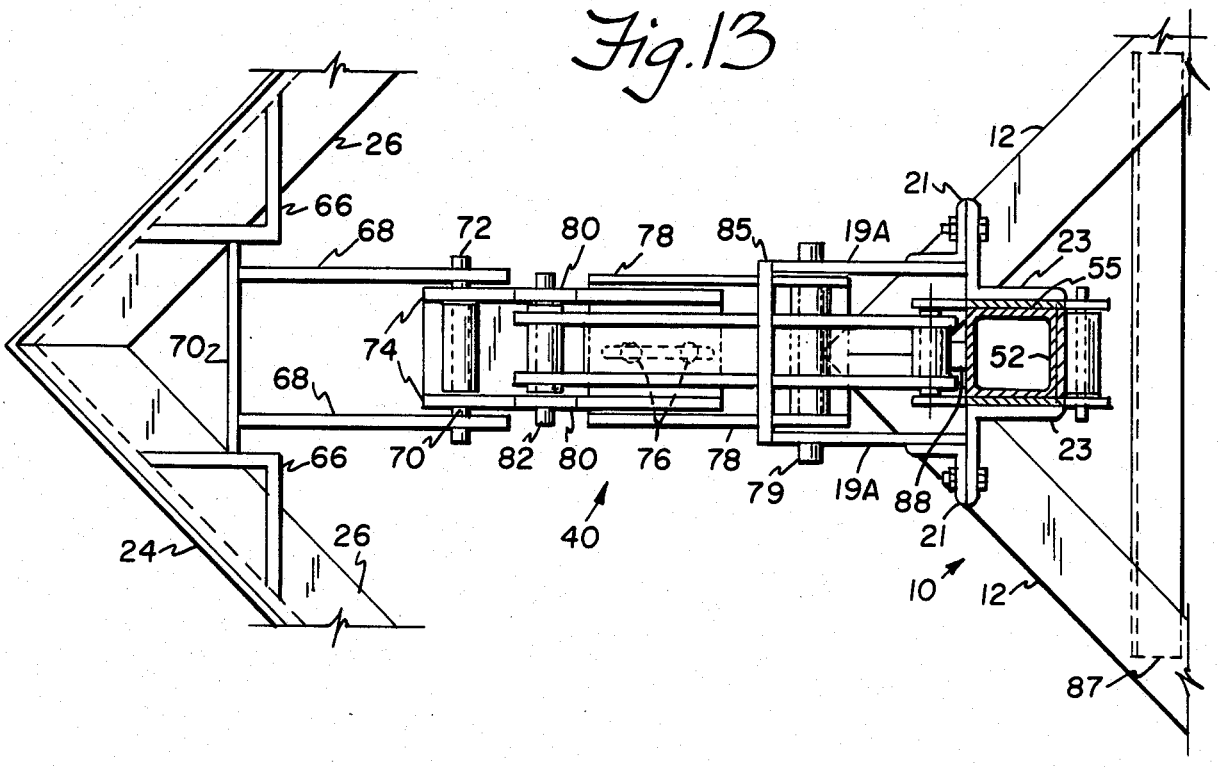
FIG. 13 is a plan view of an attachment means for a corner mold element.

Similarly, as shown in FIG. 13, the corner mold members 24 are connected through attachment means 40 to the central support member 10. While the attachment means 40 are very similar to the attachment means 32 for the side mold members, it will be appreciated from FIG. 15 that the upper linkage arm 42 is somewhat longer than the corresponding linkage arm 36 for the side mold members 22.

Figure 8:
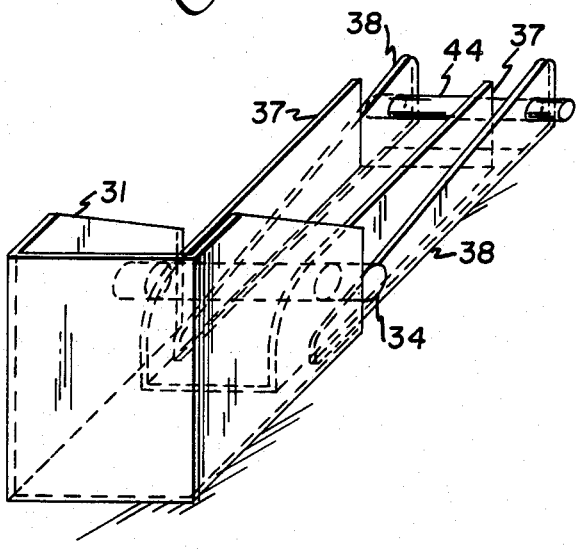
Figure 12:
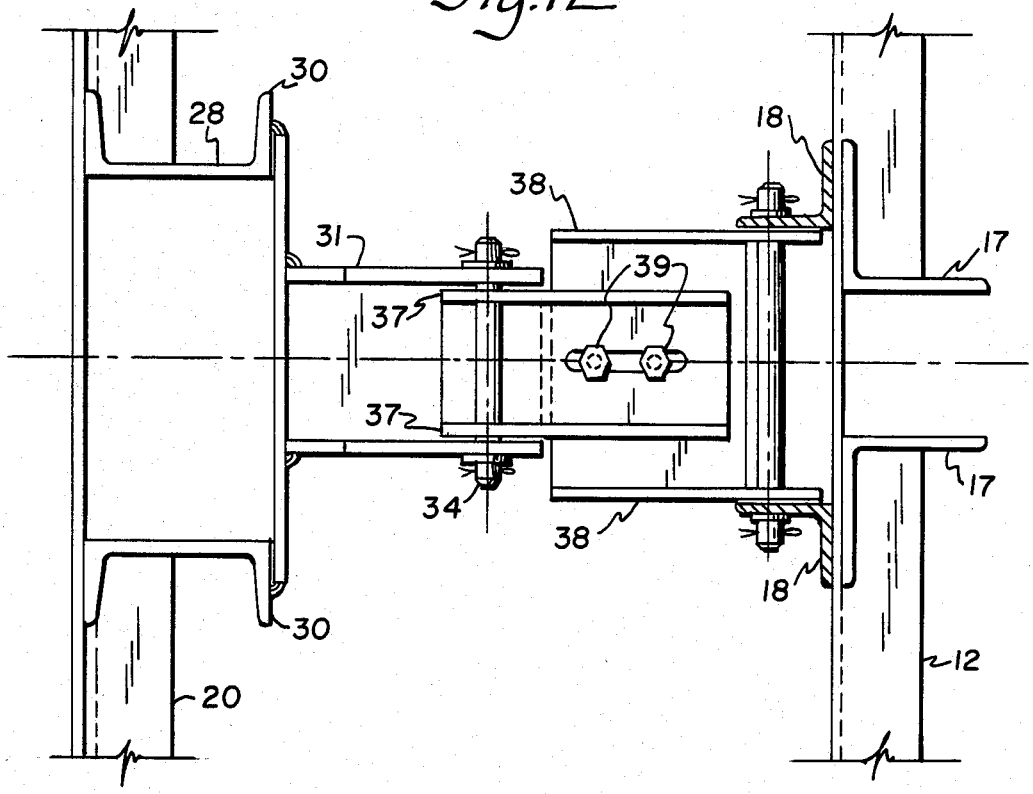
FIG. 12 is a view along lines 12—12 of FIG. 2 with the linkage arm deleted for clarity.

As shown in FIGS. 6 and 8, the lower linkage arm 37–38, which is U-shaped in form as shown in FIG. 8, has its inner end mounted on a pivot pin 44 which extends through apertures in vertical member 18 of the central support member 10. As shown in FIGS. 6 and 12, the linkage arm 37–38 is adjustable by loosening the bolts 39, sliding the two elements constituting the linkage arm 37–38 relative to each other and finally retightening bolts 39. This will permit adjustment of the mold plate so that it will extend at the desired angle, usually 90°, to the floor.

Figure 11:
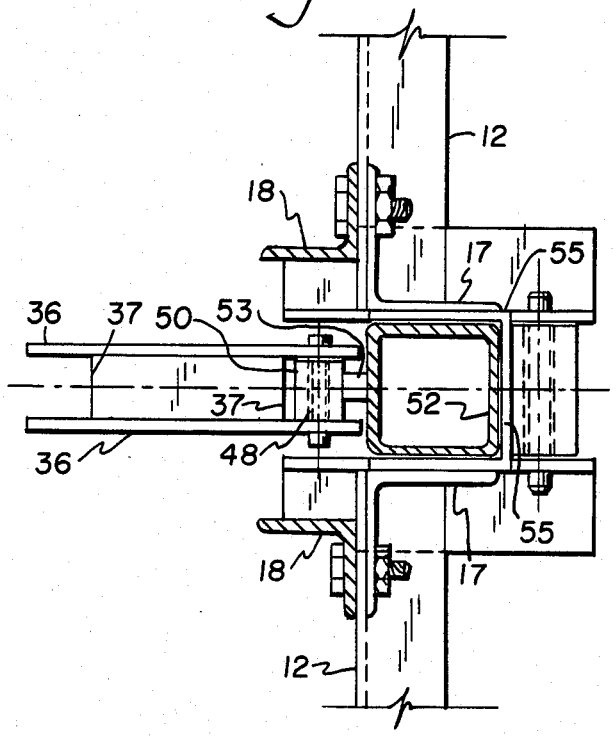
FIG. 11 is a view along lines 11—11 of FIG. 2.

As shown in FIGS. 6 and 11, linkage arm 36 is formed by two parallel plates 36 and a third reinforcement plate 37 which is perpendicular to members 36; also, it will be noted that the upper end of this linkage arm includes a pin 48 which is inserted in a vertical extending closed loop 50, this loop being attached to a movable mounted post 52 by means of a plate 53 which is welded to both the loop and the post previously mentioned.

Figure 7:
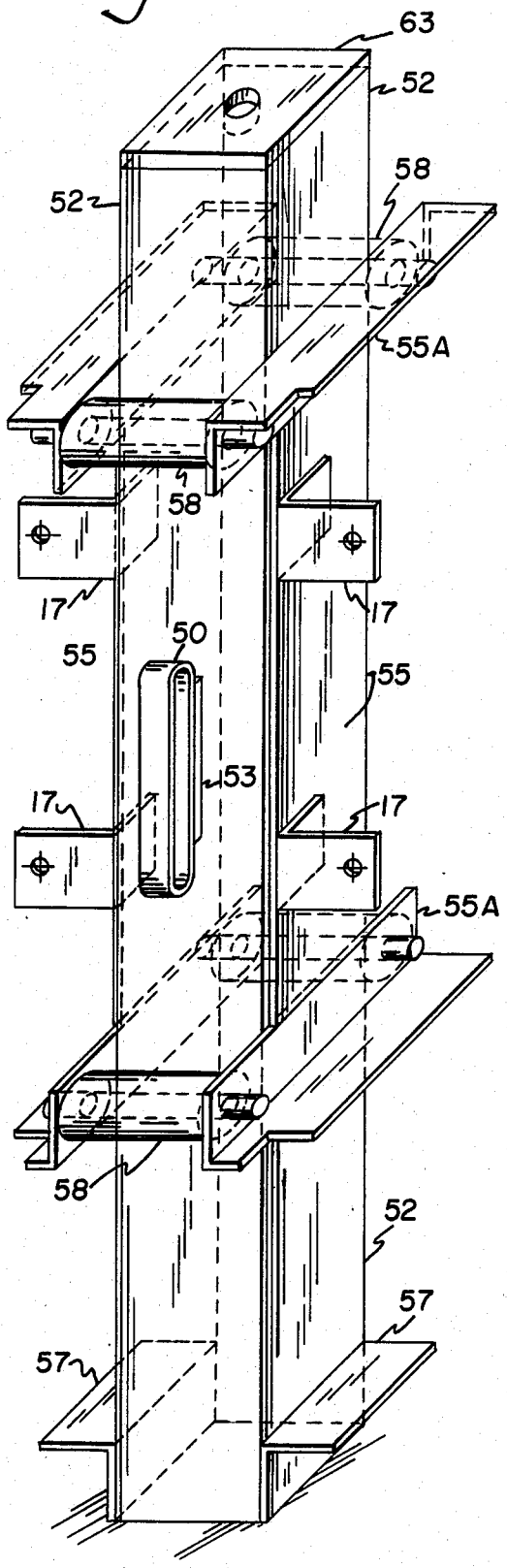
FIGS. 7-9 are perspective views of the two upper elements shown in FIG. 6.

As shown in FIG. 7, three plate members 55 having spaced welded angles 55*a* and horizontally disposed pins which carry horizontally extending rollers 58 are employed to guide the post 52. As shown in FIGS. 2, 3, 5A, 5B and 7, at its upper end 63, the post 52 is adjustably connected by a linkage device 54 to a movable lid 56.

Figure 9:
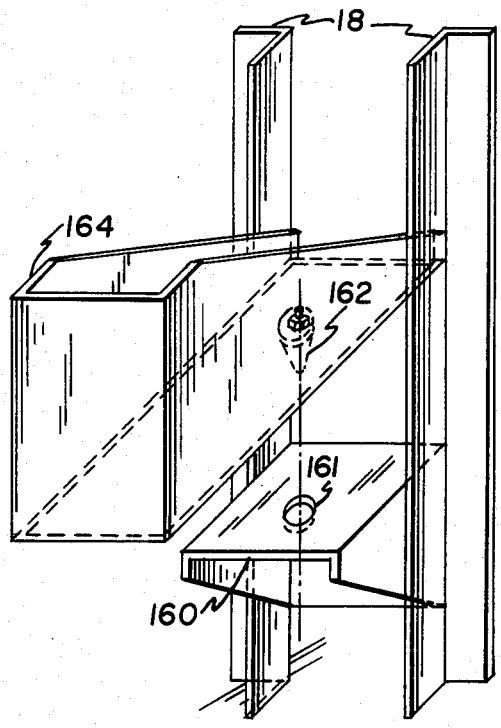
Figure 10:
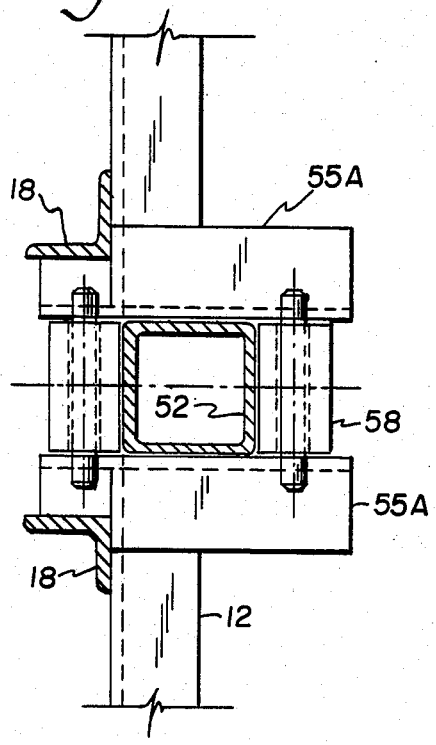
FIG. 10 is a view along lines 10—10 of FIG. 2.

As shown in FIGS. 2, 3, 5A, 5B and 6, the lid 56 is provided with a peripheral ledge 61 which will rest upon the upper end of the U-shaped members 28 and therefore provide a secure support. The ledge may be equipped with a plurality of conical pins 59 which will be inserted each into an aperture 60 in the adjacent member of the mold frame work 20 as shown in FIG. 6. With this arrangement, when concrete is poured into the cavity formed by two embodiments of the present invention, the mold members will be prevented from moving inwardly at the upper edge. As shown in FIGS. 6 and 9, a similar arrangement to the one just previously described is provided above linkage arm 91–92 where a bracket 160 is secured between angles 18 of member 10 and has an aperture 161 to receive a conical pin 162 mounted on a bracket 164 which is connected to the legs 30 of adjacent U-shaped members 28. Finally, as can be seen in FIGS. 2, 3 and 6, below the previously described mechanism and adjacent to the lower edge of each mold member, another bracket 90 is secured to member 30 in a manner similar to the arrangement shown above for bracket 31; bracket 90 serves as upper support to pieces 91–92, which are similar and serve the same purpose as pieces 37–38.

Figure 14:
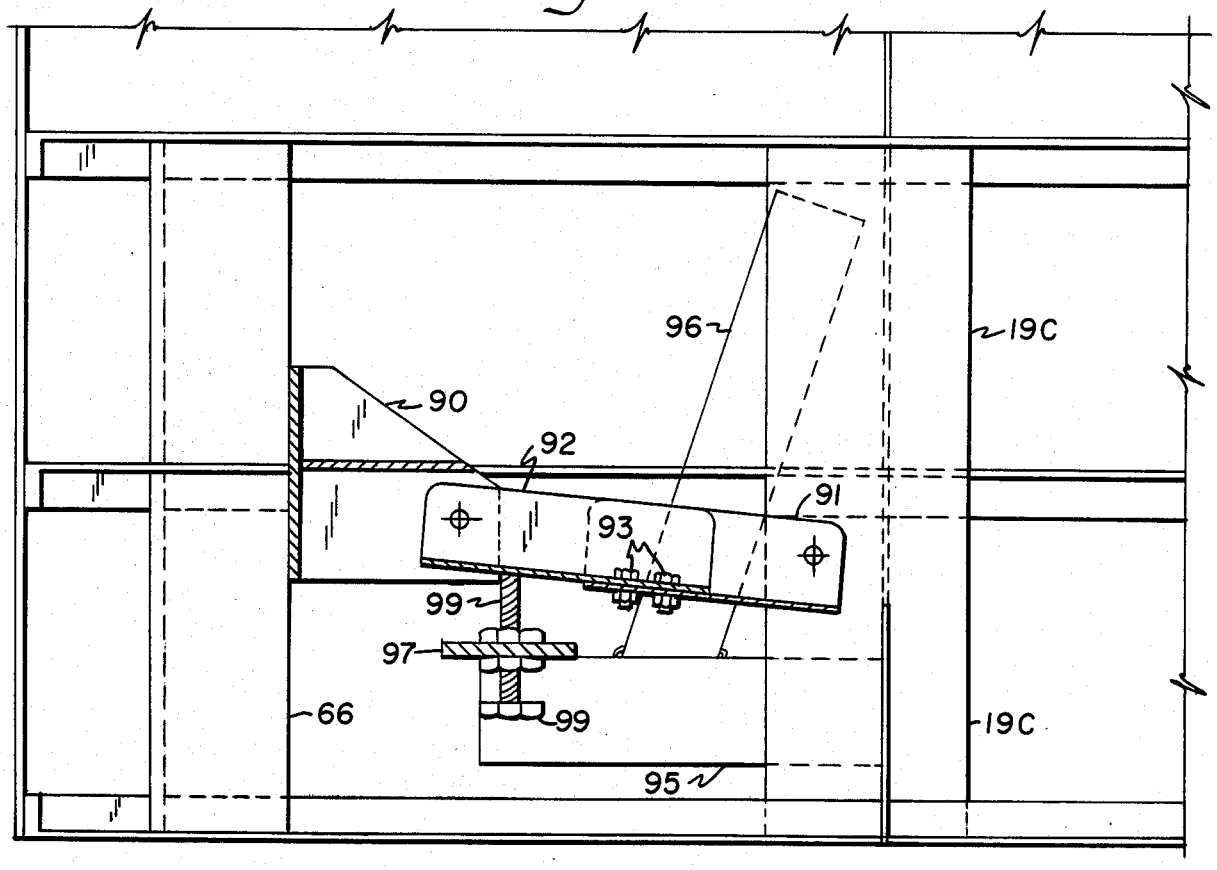
FIG. 14 is an enlarged side view, partially in section, of the corner mold attachment means with portions deleted for clarity.
Figure 15:
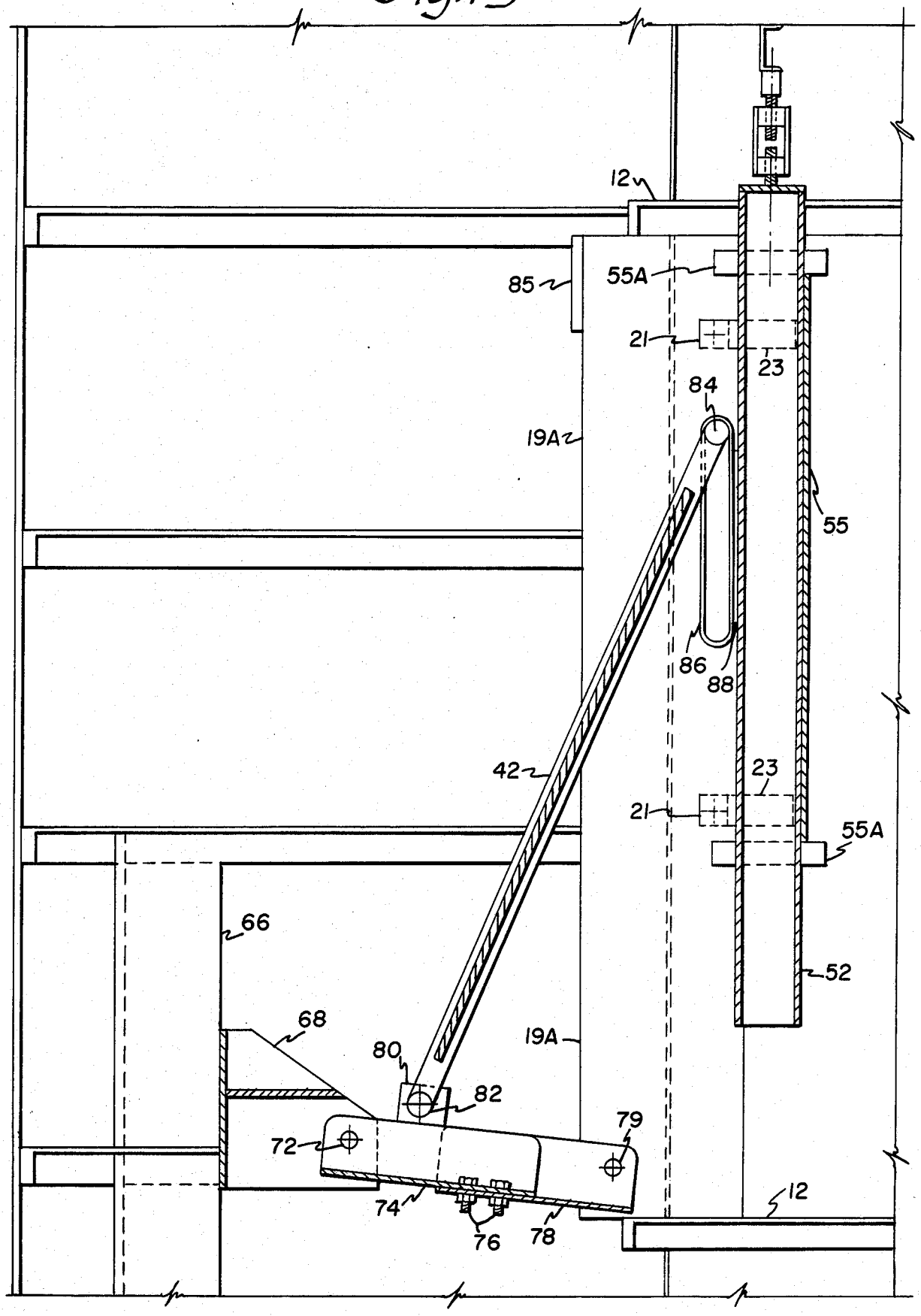
FIG. 15 is an enlarged detailed view of a corner mold attachment means with parts deleted for clarity and illustrating the lost motion connector.

Turning now to FIGS. 13–15 where the corner mold members 24–26 are shown, each corner mold member on its inside has, above its midpoint, a pair of angles 66 welded to two members 26 so as to extend vertically. A bracket member 68 has its base 70 welded to the opposing surfaces of the vertical member 66 as illustrated in FIG. 13. Adjacent to the end of the bracket 68, a pair of apertures 70 are provided for receiving a pin 72 for the purpose of mounting one end of a linkage arm 74–78, the overall length of which is adjustable by loosening the bolts 76 and sliding the opposite end 78 of the linkage arm towards or away from the pivot pin 72 and finally readjusting bolts 76. As more fully shown in FIG. 15, the upper side of the linkage arm 74–78 is provided with protruding plates 80 having apertures in which is located a pivot pin 82 on which is supported one end of a linkage arm 42. The opposite end of the linkage arm 42 is connected to a pin 84 which is trapped in an elongated loop 86 which is welded to connecting plate 88 which in turn is welded to the face of a post 52 which is identical in structure to that used for the side wall members 22 and will therefore not be further described. As shown in the same FIGS. 13 and 15, a pair of spaced angles 21 which are about four inches high, are attached by welding or bolting to vertically extending plates 19A, 19B, which extend between angles 12 and which have each a hole for passing through pin 79. The angles 21 are bolted to angles 23, which in turn are welded to plate members 55. As shown in FIG. 15, spanning the upper edges of plates 19A, 19B is a welded plate 85 which adds rigidity to this structure.

Figure 4:
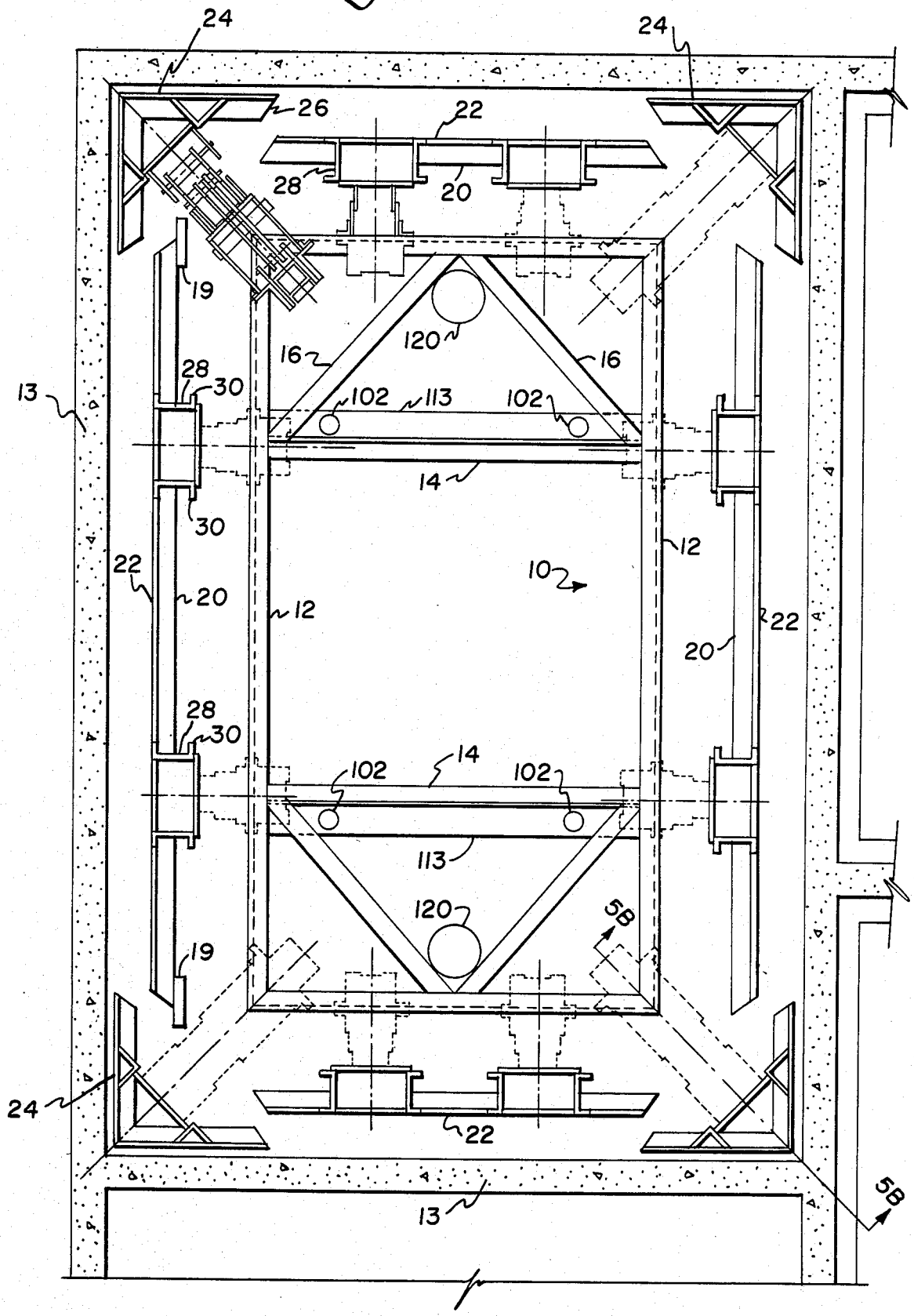
FIG. 4 is a top view of the present invention similar to FIG. 1 but with the mold members shown in their retracted positions.
Figures 5A, 5B:
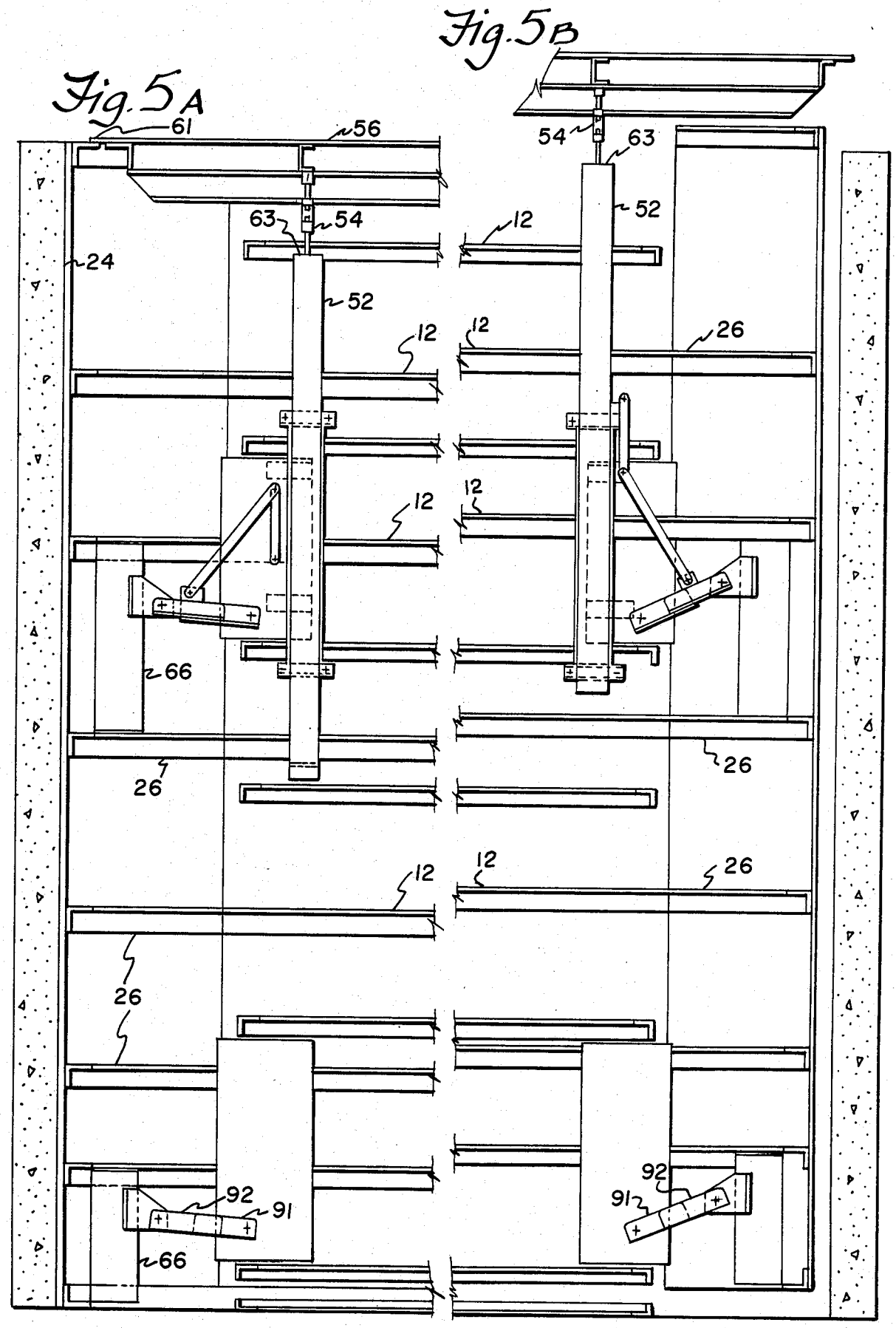
FIG. 5A is a view along lines 5A—5A of FIG. 1.
FIG. 5B is a view along lines 5B—5B of FIG. 4.
Figure 15A:
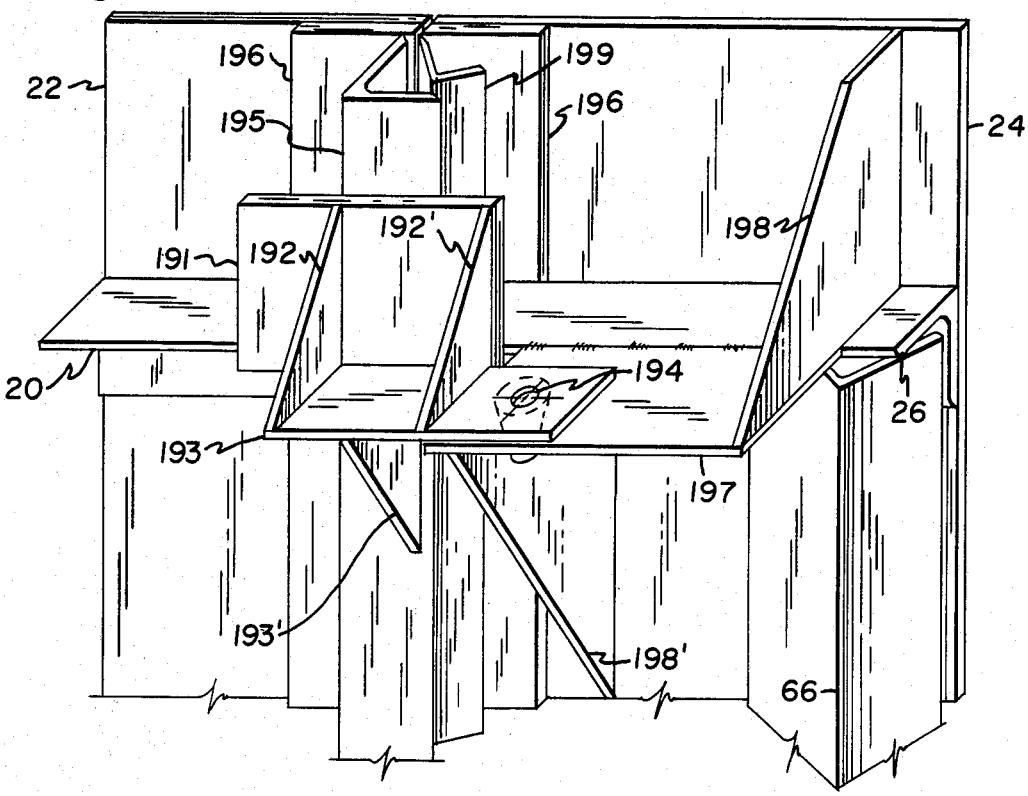
FIGS. 15A and 15B are perspective views of mechanism 19 shown in FIGS. 1 and 4.
Figure 15B:
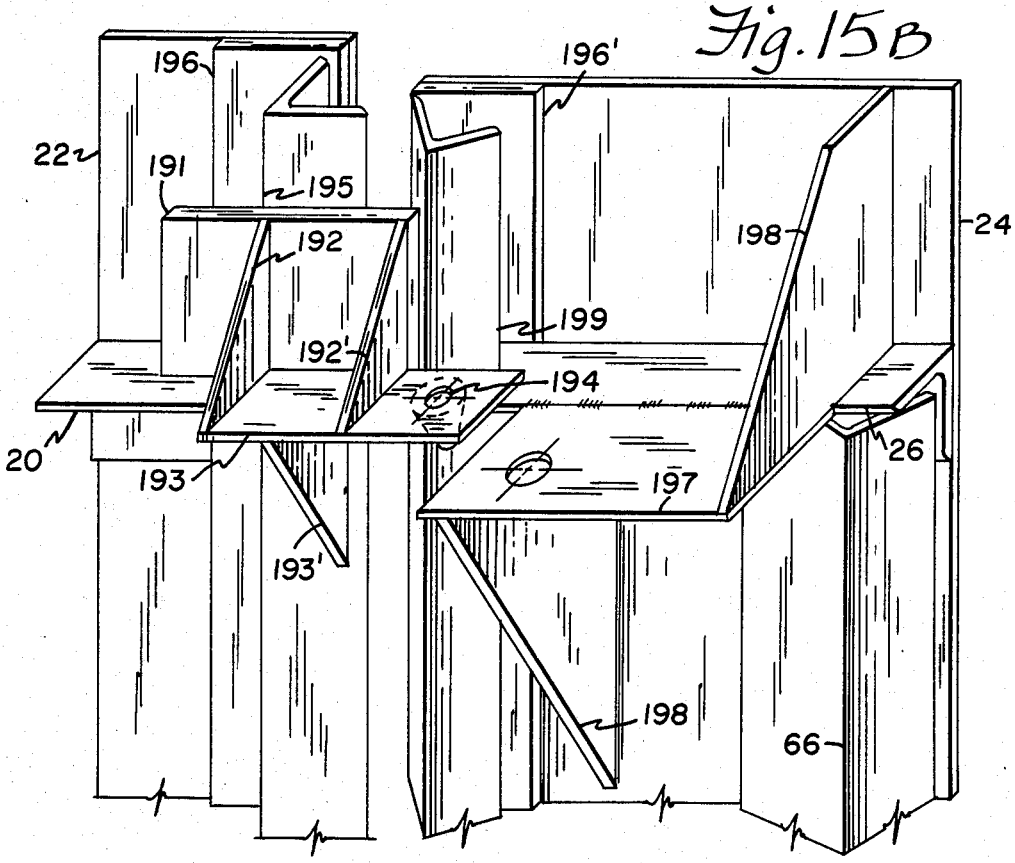

Turning now to FIGS. 15A and 15B, these are enlarged details, shown in perspective, of piece 19 indicated in FIGS. 1 and 4. As shown in the previously mentioned FIGS. 15A and 15B, it can be seen that pieces 191, 192, 192', 193, 193', 194, 195 and 196 belong to the planar mold member 22 which is reinforced by pieces 20; then, pieces 196', 197, 198, 198', and 199 are properly attached to corner mold member 24 which in turn is reinforced by pieces 26. Each corner has two identical attachments as the one previously described in order to properly fit the other two attachments of the planar members adjacent to them.

As shown in FIG. 14, a separate bracket 90 is secured to member 66 in a manner similar to the arrangement shown in FIG. 13. Just as with the linkage arm 74–78 shown in FIG. 15, in this case an identical linkage arm 91–92 has one end pivoted to bracket 90 in the same manner as the bracket 68 of FIG. 15 is connected to arm 74, and the opposite end 91 of arm 91–92 is mounted on the pivot pin which is secured in two apertures in spaced plates 19C–19D which are welded to the central support member 10. Also, as can be seen in FIGS. 6, 13, 14 and 15, the lower linkage arms 32, 74, 78, as well as the bottom linkage arms 91–92, will serve to maintain the mold plates in substantially vertical alignment. On the other hand, referring specifically to FIG. 14, in order to make sure that the corner 24 will come back to its proper place when returning to the expanded position, on the outside of each plate 19C and 19D, of which only 19C is shown, there are properly welded to them plates 95, 96 and 95', 96' (this last pair not shown); on top of plates 95 and 95' there is also welded plate 97 which is pierced by bolt 99 which in turn is properly secured by a pair of nuts.

Referring now to FIGS. 1, 2, 3, 4 and 18, a plurality of hydraulic jacks 100 are placed upside down in an opening in the lid 56 with the ends of the inverted jacks engaging the circular areas 102 on I beams 113, the ends of which are welded to the central support member 10. The bottom ends of the jacks engage a bracket member 104 which may be bolted to the top of the lid 56.

In constructing the closed loops 50 and 86 of FIGS. 6 and 15 for the respective side and corner mold members, the closed loops 86 will be of longer vertical length than the loops 50 whereby, upon actuation of the jacks 100 and lifting of the lid 56 vertically to the position illustrated in the right-hand side of FIGS. 2 and 3, the side mold members will be retracted first as the posts 52 are lifted a predetermined distance and then the corner mold members will be retracted until all of the mold members assume the positions illustrated in FIG. 4. The side mold members 22 will be retracted first as the posts 52 are lifted a predetermined distance and the corner mold members 24 will follow the retraction but to a lesser extent, the lifting of posts 52 is attained when the lid 56 is raised such as, for example, by the jacks 100. Other means such as a crane may be used to lift the lid 56. By way of example, the loops 86 of the corner molds may be approximately six inches in length, while the loops 50 may be three and three quarter inches.

With reference now to FIGS. 6, 7, 10 and 11, there are illustrated views of the post 52 in its guide members 55 and its connection 53 to the closed loop 50 which in turn serves as guide for pin 48 of linkage arm 36. In FIG. 7, the guide 55 for the post 52 includes four angle brackets 17 which are also shown in FIG. 2. The brackets 17 serve to fasten by bolts the guide 55 to the vertical angles 18 of the core member 10 as shown, e.g., in FIG. 11. At the bottom of each post 52 there are welded stop members 57, as shown, which will abut angles 56 when post 52 is raised, thus limiting the upward travel of each post 52. The location of the stop members 57 is selected, of course, to define the length of travel of each post. When the entire apparatus is to be moved, the lid 56 is raised by a crane and this movement will be transmitted to the whole apparatus through posts 52.

Figure 16:
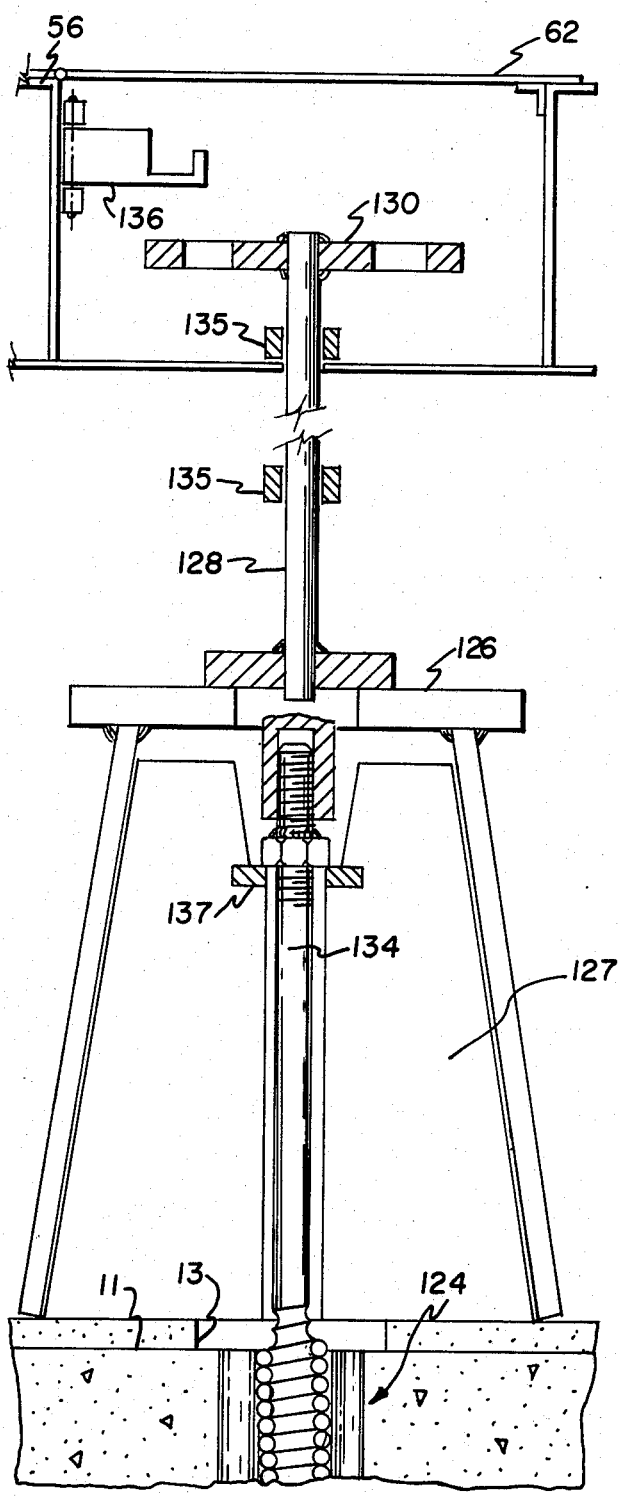
FIGS. 16 and 17 are side views, partially in section, of the anchoring means for the central support member showing different positions.
Figure 17:
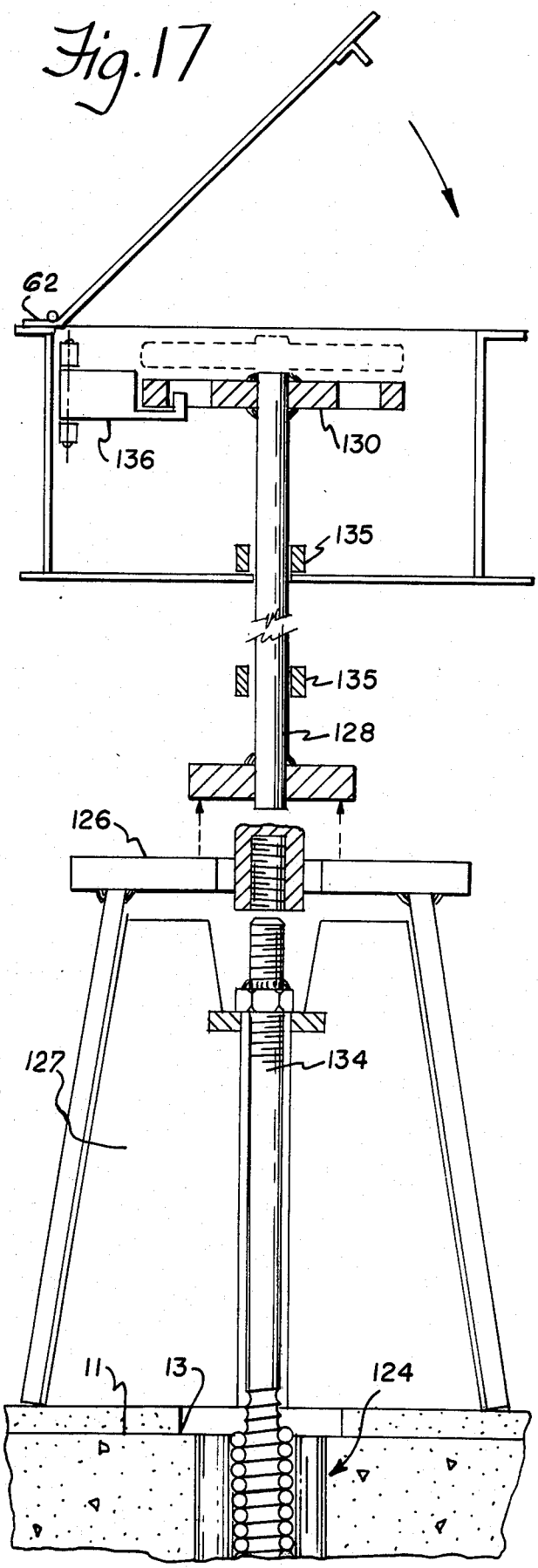

Turning now to FIGS. 16 and 17, there are illustrated the locking means 120, also shown in FIGS. 1 and 4 for the support member 10 and the operating mechanism therefore. As shown in FIGS. 1–3, two locking devices 120 are spaced apart on the bottom of the support member 10. The locking devices 120 are designed to cooperate with a centrally threaded tie screw 124 which is cast in the base or floor 11 when the floor 11 is poured. Other covering material such as tile 13 may be placed over the concrete floor. The tie screws 124 must be precisely located in the floor since their location will determine the exact location of the mold apparatus and, hence, the cast walls of the dwelling being formed. The member 127 is formed with a central bore that runs from its base to the underside of a metal washer 127; from the top part of this washer there is a hollow inverted cone that permits the entrance of a wrench that fits the nut welded to rod 134 in order to screw the lower end of this rod into tie screw 124. In operation, a worker sets in place the marking member 127, which may be metal or concrete, over tie screw 124 and then threads the rod 134 into it in order to lock member 127 in place. Also, it should be noted that washers 135 are conveniently welded to central support member 10 and will keep bar 128 in its required vertical position. Thus, when the mold apparatus is set in place as by a crane, the workers need only to make certain that the guide members 126, shaped to complement the member 127, are seated accurately on each member 127. Then, after fixing the mold apparatus in place, a worker operates handle 130 to thread the end of rod 128 onto the upper exposed end of rod 134. This arrangement eliminates all movement of the mold apparatus during casting. After hardening of the concrete, rod 128 is unscrewed by wheel 130 and raised to be engaged by swivel latch 136 during transport of the mold unit.

Figure 18:
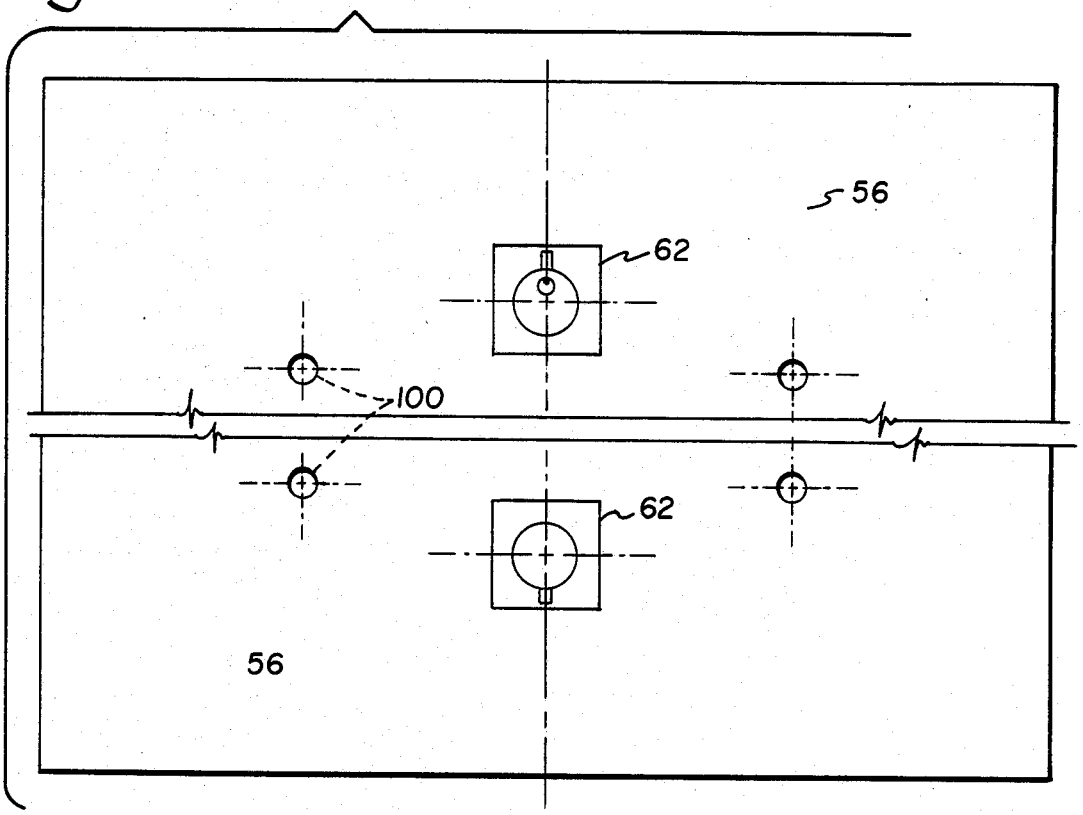
FIG. 18 is a top plan view of the lid shown in FIGS. 2, 3, 5A, 5B and 6, showing the relative disposition of the jacks and the openings for the locking means.

With reference now to FIG. 18, there is shown a top plan view of the lid 56 illustrating the relative disposition of the jacks 100 and the openings 62. Access to the interior of the apparatus may be had through openings in lid 56 (not shown), which may be provided with safaty covers. A pair of openings 62 shown in FIGS. 16, 17 and 18, provide access in the lid 56 to locking devices such as at 120 as previously described.

Figure 19:
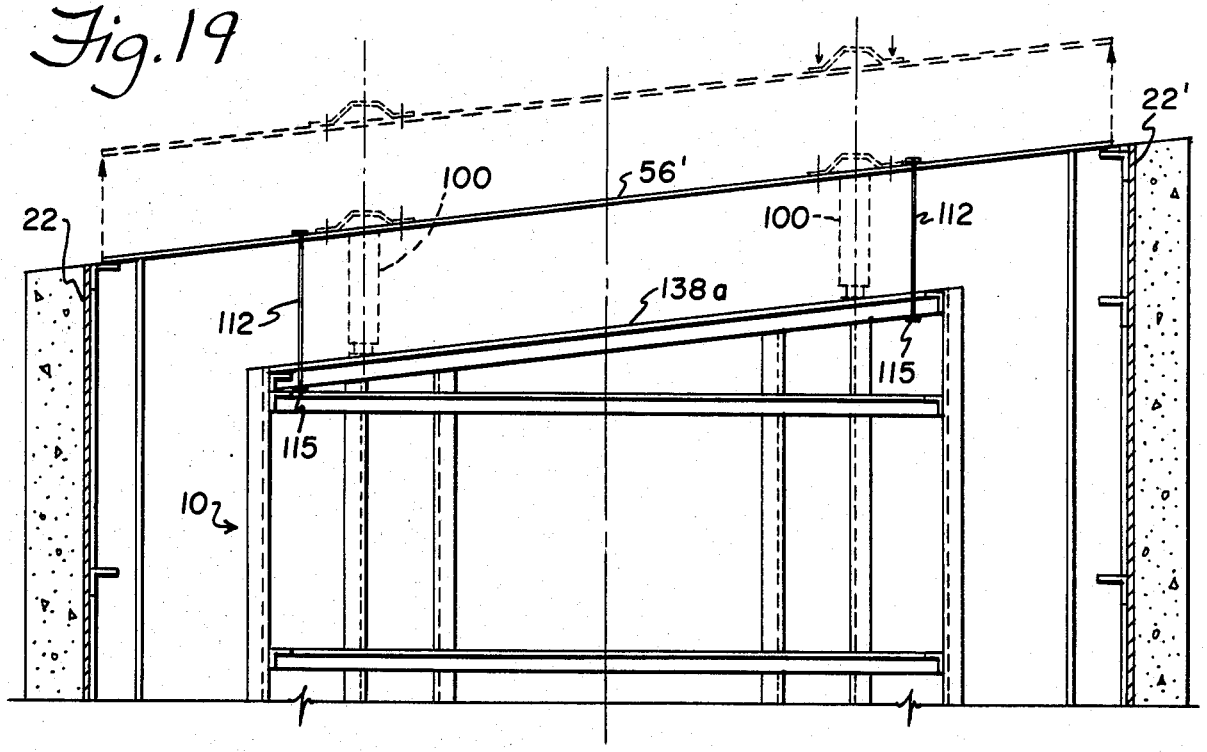
FIG. 19 is a side view in section of an application of the present invention for a sloped roof structure.

In FIG. 19 there is shown an embodiment of the present invention where the side molding members are of different height as shown at 22 and 22' so that a sloping roof can be installed. In this embodiment, the central support member 10 also has a sloping upper end 138*a*. In other respects, the apparatus is identical to that previously described. In the same FIG. 19 another feature of the present invention is illustrated. Specifically, the upper end of support member 10 is provided with several apertures for receiving locking bolts 112, four of which should be provided. Locking nuts 115 are welded to members of the support 10 to receive the threaded ends of bolts 112. The upper ends of bolts 112 have enlarged heads which rest on the top surface of the lid 56. The bolts 112 when unthreaded from nuts 113 are free to be pulled up with the lid when the lid is raised.

Figure 20:
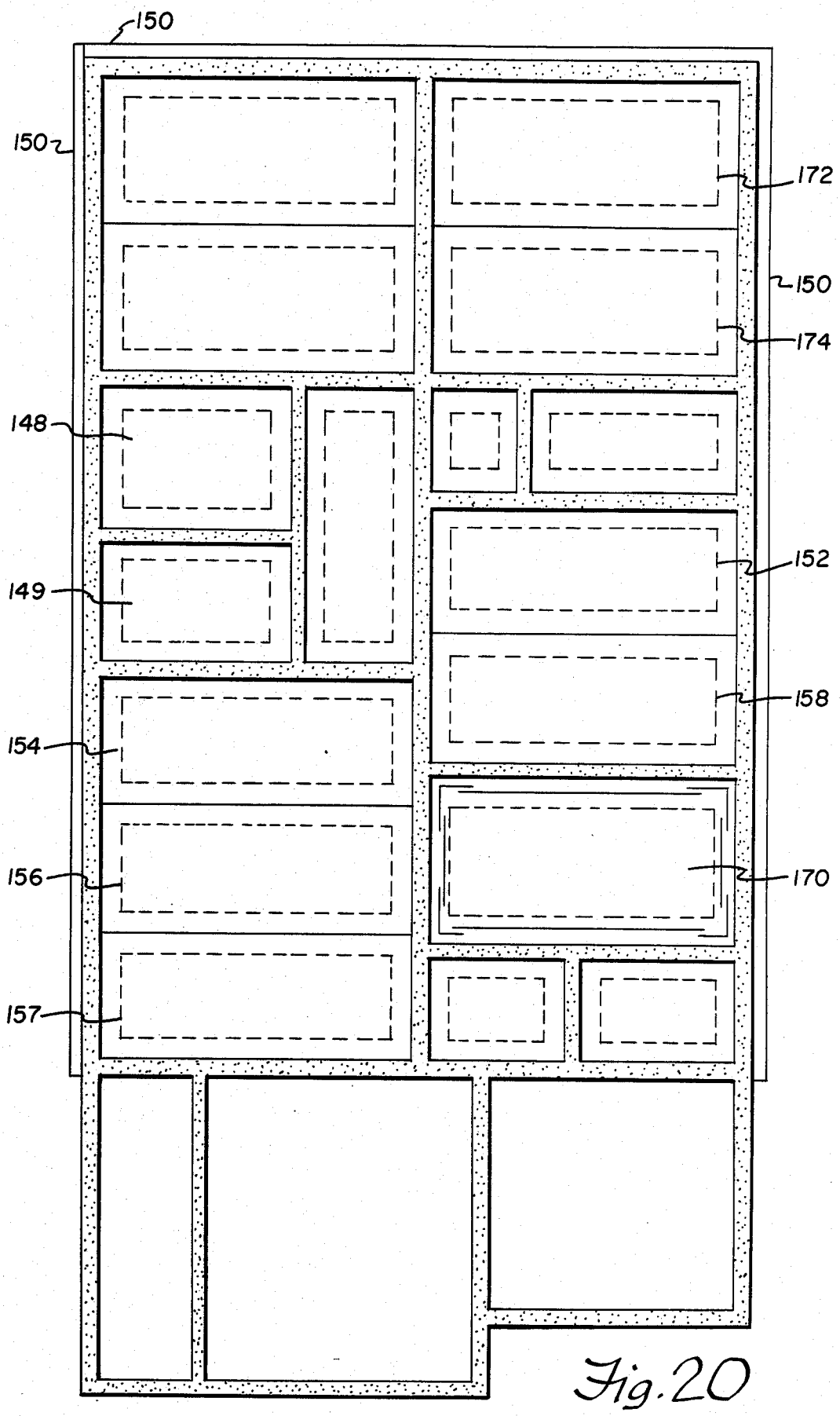
FIG. 20 is a plan view of a dwelling showing the cast walls with some of the mold members removed, one mold member in a retracted position preparatory for its removal and various arrangements and sizes of mold members used to form differently sized rooms.

With reference to FIG. 20, with a number of molding units of the present invention set in place as illustrated, the conventional mold forms 150 are also set in place but only about the periphery of the exterior of the mold units at a distance corresponding to the thickness of the outside walls being cast. No conventional mold units are needed to form any interior wall of the building. On the interior, adjacent mold units such as 148 and 149 are spaced apart to provide a cavity of suitable thickness. Some of the mold units may have their mold faces placed in abutting relation with an adjacent unit to produce a large room as at 152–158, 172–174, and as at 154, 156 and 157. At 170, the flat mold plates and the corner molds are shown in their retracted position. It will also be noted that at the bottom of FIG. 20 all the units employed there, as well as the conventional exterior mold forms, have already been taken out. Preferably, one will set in place all of the mold units on a finished floor according to a selected floor plan and then proceed to cast all of the interior and exterior walls. After the cast material hardens, the mold units and the conventional exterior molds are removed as shown at the bottom of FIG. 20 and then transported to another site.

A number of arrangements will be apparent to those skilled in this art, who will be able to vary the floor plan of a structure.

As is customary, the mold plates 22 and the exterior molds will have been previously lubricated to facilitate separation from the cast surfaces.

In operating the mold units, the jacks 100 will be simultaneously actuated to lift the lid 56 vertically relative to the support member 10. The linkage assemblies 32 and 40 are substantially at identical heights above the floor 11. Upward movement of the lid 56 will effect upward and inward movement of the frameworks 20 and associated mold plates 22 to the position illustrated in FIG. 4 whereby the mold plates 22 will be separated from the cast walls 13.

It will be apparent to those skilled in the art that mold elements for forming the empty spaces for doors or windows in the cast walls 13 may be added between the mold plates or between a mold plate and the conventional mold.

It will be understood that the apparatus of this invention may be readily used to form walls in highrise buildings. For example, the first floor may be cast and then, after the units of the present invention are removed, a slab is poured on top of the previously formed walls. Thereafter the apparatus is employed again to form the walls of the upper level and so on with each succeeding level.

Having described the invention, it will be apparent to those skilled in this art that various modifications may be made thereto without departing from the spirit and scope of this invention as defined in the appended claims.

What is claimed:

1. A movable molding apparatus for forming walls of a building structure at a site having a base, comprising:

central support means having a lower end for engaging the base so that said support means is free standing thereon and an upper end, said support means having sides and at least two corners, a plurality of side mold members each associated with one of said sides with each said side mold member having a substantially planar mold surface, each side having a plurality of attachment means for attaching each associated mold member to a respective side of said support means so that said mold members are capable of limited relative movement with respect to said support means between a fully extended and a retracted position, actuating means for effecting said relative movement, said actuating means being associated with said upper end of said support means and being movable with respect thereto away from said upper end, said apparatus including means connecting said mold members to said actuating means whereby movement of said actuating means away from said support means will effect movement of said mold members toward said support means;

said means connecting said mold members to said actuating means comprising linkage means having one portion pivotally connected to a said mold member and another portion pivotally connected to a slide member, said slide member being attached to said actuating means and being movable in a cage means, in response to movement of said actuating means, away from said lower end of said central support means, said cage means being rigidly attached to said central support means, said slide member having abutment means for engaging a stop member carried on said support means, to prevent withdrawal of said slide member from said cage means, movement of said slide member through a selected distance resulting in movement of said linkage means to thereby effect said movement of said mold members;

each said side having at least two of said connecting means;

said corners of said support means having at least two vertically spaced connecting elements mounted thereon, said apparatus including for each of said corners a corner mold member with a said corner mold member being associated with a said corner of said support means through said respective connecting elements;

said apparatus including secondary means connecting said corner mold members to said actuating means so that, upon movement of said actuating means away from lower end of said support means, initially said side mold members will be moved toward said support means and subsequently said corner mold members will be moved toward said support means.

2. The invention as claimed in claim 1 wherein said actuating means include platform means disposed to extend over said upper end of said support means.

3. The invention as claimed in claim 1 wherein means for moving said actuating means away from said upper end of said support means are provided.

4. The invention as claimed in claim 3 wherein said means for moving include at least one hydraulic jack removably carrried by said apparatus.

5. The apparatus as claimed in claim 1 wherein said linkage means includes a first linking arm having a first end pivotally connected to said slide member and a second end connected to a pivot pin on said mold member, a second linking arm having a first end pivotally connected to said central support means and a second end connected to said pivot pin.

6. The apparatus as claimed in claim 5 wherein said first linking arm is longer than said second linking arm.

7. The apparatus as claimed in claim 5 wherein said second linking arm is adjustable in length.

8. The apparatus as claimed in claim 5 wherein said slide member includes a vertically extending loop having an upper and a lower end and said first end of said first linking arm includes a roller captured in said loop so that movement of said linkage means will commence when said roller is engaged by said lower end of said loop.

9. The apparatus as claimed in claim 1 wherein said cage means comprises a column having an open side and upper and lower ends with said slide member being slideably disposed in said column and having one face exposed through said open side, said one face having secured thereto loop means, said another portion of said linkage means having a roller mounted thereon, said roller being disposed substantially within said loop means and being movable from the upper end thereof, corresponding to said mold member being in a fully extended position, to the lower end whereby further movement of said slide member in said column will transmit a retraction force through said linkage means to a said mold member.

10. The apparatus as claimed in claim 1 wherein said slide member has an upper end which is provided with means connecting said upper end to said actuating means, said connecting means being initially adjustable in length.

11. The apparatus as claimed in claim 1 wherein rigid spacing means are provided between each mold member and said central support means to prevent movement of a said mold member toward said central support means when said mold members are fully extended from said central support member, said spacing means including a first member connected to said mold member and a second member mounted on said central support means in a position such that as said mold member is moved to a fully extended position, said first and second members will interengage.

12. The apparatus as claimed in claim 11 wherein said first member is a pin carried on a bracket and said second member is another bracket having an aperture for receiving said pin.

13. The apparatus as claimed in claim 1, wherein each said mold member has a lower edge and a pivot arm having one end pivotally connected adjacent said lower edge and an opposite end pivotally connected to the lower end of said central support means to control the vertical alignment of said mold member during movement thereof.

14. The invention as claimed in claim 2 wherein said platform means is a hollow lid movably mounted on the upper end of said support means.

15. The invention as claimed in claim 1, wherein said support means is provided with four sides with each said side having a plurality of said attachment means, said apparatus including a side mold member associated with each said side of said support means.

16. The invention as claimed in claim 15, wherein said support means has four corners with at least two vertically spaced connecting elements mounted on each of said corners, said apparatus including four corner mold members with a said corner mold member associated with a said corner of said support means through said respective connecting elements.

17. The invention as claimed in claim 1, wherein said mold members are each substantially flat sheets of stiff material for forming flat walls in cooperation with external, similarly shaped mold elements.

18. The invention as claimed in claim 1, wherein said apparatus includes means for adjustably anchoring said central support means to the base upon which the walls are to be formed.

19. The invention as claimed in claim 16 wherein each said side mold member includes locating means for engaging an adjacent portion of a said corner mold member when said mold members are in a position spaced from said central support means.

* * * * *